US010307779B2

(12) United States Patent
Scott et al.

(10) Patent No.: US 10,307,779 B2
(45) Date of Patent: Jun. 4, 2019

(54) DUAL-CHAMBERED BOTTLES FOR STORING AND DISPENSING OF FLUID AND SEMI-FLUID MATERIALS

(71) Applicant: ST&T PACKAGING PTE. LTD., Singapore (SG)

(72) Inventors: Michael Scott, San Francisco, CA (US); Huankun Lao, Shangyu (CH)

( * ) Notice: Subject to any disclaimer, the term of this patent is extended or adjusted under 35 U.S.C. 154(b) by 0 days.

(21) Appl. No.: 15/144,548

(22) Filed: May 2, 2016

(65) Prior Publication Data

US 2016/0318055 A1 Nov. 3, 2016

Related U.S. Application Data

(60) Provisional application No. 62/155,619, filed on May 1, 2015.

(51) Int. Cl.
*B05B 11/00* (2006.01)

(52) U.S. Cl.
CPC ..... *B05B 11/3084* (2013.01); *B05B 11/0054* (2013.01); *B05B 11/0038* (2018.08); (Continued)

(58) Field of Classification Search
CPC ..... B65D 81/325; B65D 83/0033; B05B 11/3084; B05B 11/0048; B05B 11/0054; (Continued)

(56) References Cited

U.S. PATENT DOCUMENTS 3,269,605 A * 8/1966 Silver ..... B65D 83/68 222/135
3,760,986 A 9/1973 Castner et al.
(Continued)

FOREIGN PATENT DOCUMENTS

WO WO 2014081136 A1 * 5/2014 ..... B65D 81/3205

OTHER PUBLICATIONS

PatentScope (WIPO) Machine Translation of WO 2014/081136.*

*Primary Examiner* — Charles Cheyney
(74) *Attorney, Agent, or Firm* — Polsinelli PC

(57) ABSTRACT

In one embodiment a fluid dispensing apparatus includes a first dispensing bottle configured to dispense a first liquid, a second dispensing bottle configured to dispense a second liquid, an exterior casing. The first dispensing bottle may include a first hollow, tubular internal chamber, a first moveable piston slidably housed within the first internal chamber, a first nozzle housing, and a first nozzle collar mounted on a top end of the first internal chamber and supporting the first nozzle housing. The first nozzle housing may include a first inlet, a first pump assembly, and a first dispensing nozzle. The second dispensing bottle may include a second hollow, tubular internal chamber, a second moveable piston slidably housed within the second internal chamber, a second nozzle housing, and a second nozzle collar mounted on a top end of the second internal chamber and supporting the second nozzle housing. The second nozzle housing may include a second inlet, a second pump assembly, and a second dispensing nozzle. The exterior casing may house the first and second internal chambers. The exterior casing may include an upper opening and a sleeve disposed thereon. The sleeve may have inner contours complementary to the first and second nozzle housings such that the first and second nozzle housings at least partially protrude through the sleeve.

14 Claims, 7 Drawing Sheets

(52) U.S. Cl.
CPC ..... *B05B 11/00416* (2018.08); *B05B 11/3047* (2013.01); *B05B 11/3074* (2013.01)

(58) Field of Classification Search
CPC ..... B05B 11/0038; B05B 11/00416; B05B 11/3047; B05B 11/3074; A45D 40/24
USPC ..... 222/129–145.8, 326, 135, 260, 183
See application file for complete search history.

(56) References Cited

U.S. PATENT DOCUMENTS 4,773,562 A * 9/1988 Gueret ..... A45D 40/24 222/135
5,224,627 A * 7/1993 Weag ..... B05B 11/0048 222/135
5,351,862 A * 10/1994 Weag ..... B05B 11/0048 222/145.3
5,740,947 A 4/1998 Flaig et al.
6,170,708 B1 1/2001 Chen et al.
6,230,935 B1 5/2001 Mack et al.
6,341,717 B2 * 1/2002 Auer ..... B05B 11/3029 222/135
7,063,235 B2 * 6/2006 Auer ..... B05B 11/0064 222/135
7,222,752 B2 5/2007 Ponton
7,497,354 B2 3/2009 Decottignies et al.
7,654,415 B2 * 2/2010 van der Heijden ..... B05B 11/3084 222/129
7,654,418 B2 2/2010 Law et al.
77,936,799 9/2010 Reggiani
8,413,849 B2 * 4/2013 Flores ..... A47K 5/1202 222/135
8,418,887 B2 4/2013 Milian et al.
8,608,029 B2 * 12/2013 Lee ..... A45D 34/00 222/135
8,800,818 B2 8/2014 Greenberg
9,162,241 B2 * 10/2015 Holzmann ..... B05B 11/3084
9,446,424 B2 * 9/2016 Mathiez ..... A45D 34/04
9,452,440 B2 * 9/2016 Taggart ..... B05B 11/0078
9,517,482 B2 * 12/2016 Kim ..... A45D 34/00
9,668,562 B2 * 6/2017 Lee ..... A45D 34/04
9,693,619 B2 * 7/2017 Ki ..... A45D 34/04
2004/0188464 A1 * 9/2004 Auer ..... B05B 11/0064 222/135
2005/0103801 A1 5/2005 Felten et al.
2005/0127100 A1 * 6/2005 Reggiani ..... A45D 40/24 222/135
2006/0000926 A1 * 1/2006 Decottignies ..... B05B 11/3084 239/302
2013/0015207 A1 1/2013 Alvarado
2013/0140332 A1 6/2013 Csaszar

* cited by examiner

DUAL-CHAMBERED BOTTLES FOR STORING AND DISPENSING OF FLUID AND SEMI-FLUID MATERIALS

CROSS REFERENCE TO RELATED APPLICATIONS

This application claims priority to U.S. Provisional Application Ser. No. 62/155,619 entitled DUAL-CHAMBERED BOTTLES FOR STORING AND DISPENSING OF FLUID AND SEMI-FLUID MATERIALS filed on May 1, 2015, which is hereby incorporated by reference for all purposes.

BACKGROUND

The present disclosure relates generally to dual-chambered bottles for storing and dispensing fluid and/or semi-fluid materials. In particular, dual-chambered bottles for alternate dispensing and simultaneous dispensing of are described.

Fluid and semi-fluid products (e.g., lotions, cosmetics, serums, balms, creams, oils, pastes, gels, soaps, etc.) are often packaged in bottles with a pump for metered dispending of the product. Known bottles are not entirely satisfactory for the range of applications in which they are employed. For example, existing fluid and/or semi-fluid product bottles are single chambered and allow storage of only a single product type. Some products, however, have increased, improved, and/or more desirable activity when used in combination and/or in sequence with another product. In addition, conventional single-chambered bottled products require carrying of multiple bottles during travel.

Thus, there exists a need for bottles for storing and dispensing fluid and/or semi-fluid materials that improve upon and advance the design of known dispensing bottles. Examples of new and useful dispensing bottles relevant to the needs existing in the field are discussed below.

SUMMARY

In one embodiment a fluid dispensing apparatus comprises a first dispensing bottle configured to dispense a first liquid, a second dispensing bottle configured to dispense a second liquid, an exterior casing. The first dispensing bottle may comprise a first hollow, tubular internal chamber, a first moveable piston slidably housed within the first internal chamber, a first nozzle housing, and a first nozzle collar mounted on a top end of the first internal chamber and supporting the first nozzle housing. The first nozzle housing may comprise a first inlet, a first pump assembly, and a first dispensing nozzle. The second dispensing bottle may comprise a second hollow, tubular internal chamber, a second moveable piston slidably housed within the second internal chamber, a second nozzle housing, and a second nozzle collar mounted on a top end of the second internal chamber and supporting the second nozzle housing. The second nozzle housing may comprise a second inlet, a second pump assembly, and a second dispensing nozzle. The exterior casing may house the first and second internal chambers. The exterior casing may comprise an upper opening and a sleeve disposed thereon. The sleeve may have inner contours complementary to the first and second nozzle housings such that the first and second nozzle housings at least partially protrude through the sleeve.

In another embodiment, a fluid dispensing apparatus may comprise a first dispensing bottle configured to dispense a first liquid, a second dispensing bottle configured to dispense a second liquid, and an exterior casing. The first dispensing bottle may comprise a first hollow, tubular internal chamber, a first moveable piston slidably housed within the first internal chamber, a first portion of a shared nozzle housing, and a first nozzle collar mounted to a top end of the first internal chamber and connected to the first portion of the shared nozzle housing. The first portion of the shared nozzle housing may comprise a first inlet, a first pump assembly, and a first dispensing nozzle. The second dispensing bottle may comprise a second hollow, tubular internal chamber, a second moveable piston slidably housed within the second internal chamber, a second portion of the shared nozzle housing, and a second nozzle collar mounted to a top end of the second internal chamber and connected to the second portion of the shared nozzle housing. The second portion of the shared nozzle housing may comprise a second inlet, a second pump assembly, and a second dispensing nozzle. The exterior casing may house the first and second internal chambers. The exterior casing may comprise an upper opening and a sleeve disposed thereon. The sleeve may have inner contours complementary to the shared nozzle housing such that the shared nozzle housing at least partially protrudes through the sleeve.

DETAILED DESCRIPTION

The disclosed dual-chambered dispensing bottles will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of dual-chambered dispensing bottle examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
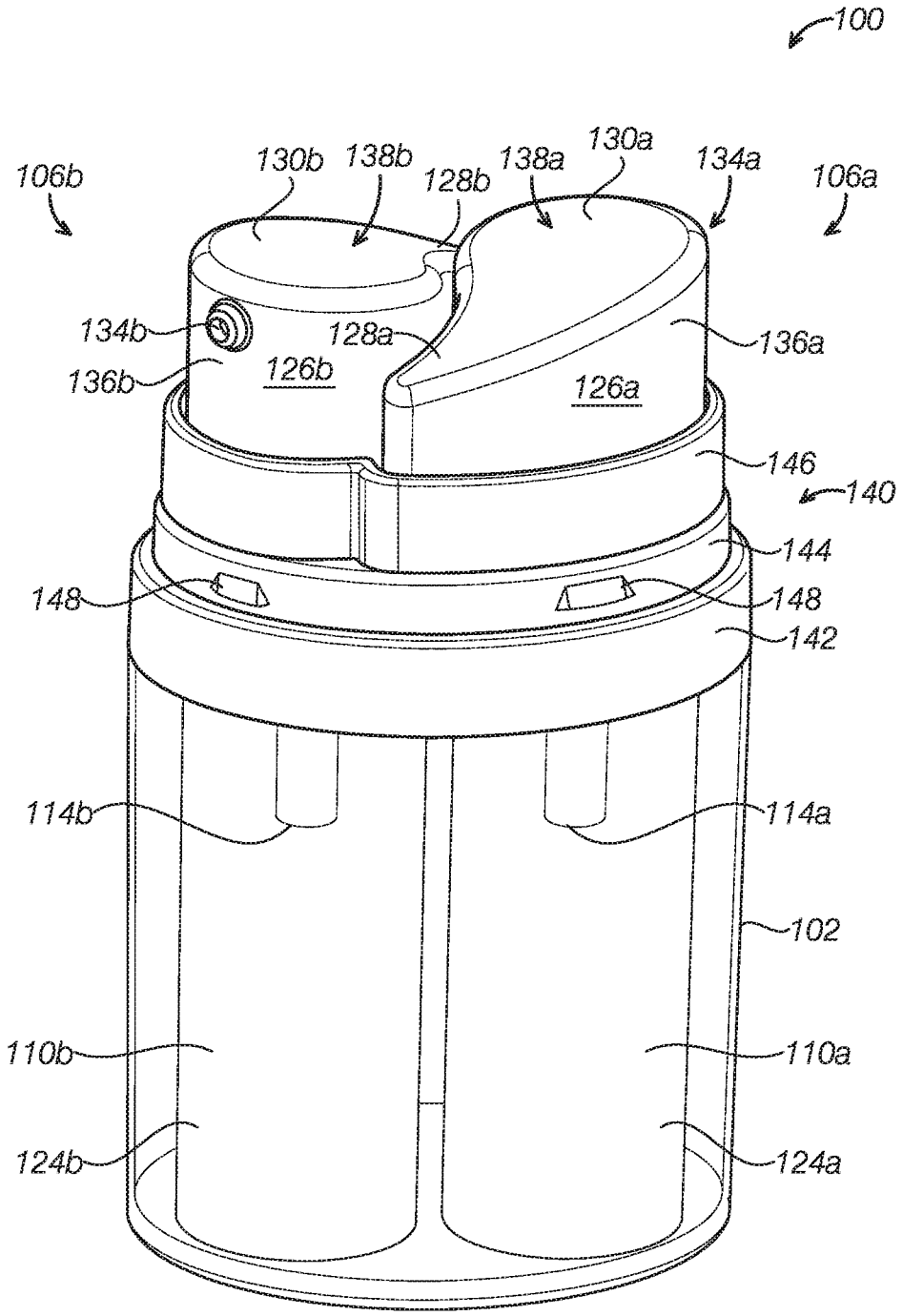
FIG. 1 is a perspective view of a first embodiment of a dual-chambered dispensing bottle.

With reference to FIG. 1 a first example of a dual-chambered dispensing bottle, bottle 100, will now be described. Bottle 100 functions to dispense two fluid and/or semi-fluid materials (e.g., lotions, cosmetics, serums, balms, creams, oils, pastes, gels, soaps, etc.) from separate chambers within the bottle. Additionally or alternatively, bottle 100 can be used to alternately dispense one material, and then the second material. Further, bottle 100 can be used for storage and transportation of the two separate materials.

Bottle 100 addresses many of the shortcomings existing with conventional fluid dispensing bottles. For example, bottle 100 allows for storage, transportation, and dispensing of more than one material (i.e., fluid and/or semi-fluid material) from a single container. In another example, for materials that are intended to be used in combination or in sequence, both materials are packaged and stored together for convenient combined and/or sequenced use.

As shown in FIG. 1, bottle 100 includes an exterior casing 102, a first nozzle 106*a*, and a second nozzle 106*b*. Exterior casing 102 is configured to house more than one internal chamber. In the present example, the exterior casing houses two internal chambers 110*a*, 110*b*. The first internal chamber 110*a* is in fluid communication with nozzle 106*a*. The second internal chamber 110*b* is in fluid communication with nozzle 106*b*. Nozzles 106*a* and 106*b* are separately actuatable (i.e., their nozzle housings are non-attached). As can be appreciated, however, because nozzle housings 126*a* and 126*b* are located adjacent each other, a user may simultaneously depress both nozzle housings if desired.

In the illustrated embodiment, nozzles 106*a* and 106*b* are located on opposing sides of the bottle and are faced outwardly from the bottle in opposing directions. In other embodiments, nozzles 106*a* and 106*b* may be located proximal each other.

As shown in FIG. 1, nozzle housings 126*a* and 126*b* may be seated within and vertically actuatable/moveable within a sleeve 140. Sleeve 140 may be mounted on an upper opening of exterior casing 102. Sleeve 140 may have inner contours complimentary to first and second nozzle housings 126*a*, 126*b*. Thus, first and second nozzle housings 126*a*, 126*b* may at least partially protrude through sleeve 140.

In the illustrated embodiment, sleeve 140 may include three stepped portions 142, 144, and 146. Stepped portion 142 may be attachable to the upper opening of external casing 102. Stepped portion 144 may include flanges 148 that are configured to engage with complimentary flanges in lid 108 (shown in FIG. 5) for releasable snap-fitting of the lid to the sleeve. Sleeve 140 may be complimentarily configured to the nozzle housings and limit lateral movement of the nozzle housings.

Still referring to FIG. 1, nozzle housing 126*a* may have a sloped top surface 138*a*. Specifically, the top surface may be raised in the region of head 130*a* relative to tail 128*a* (i.e., the tail is lower than the head). More specifically, the top surface may be generally downwardly sloped at a lesser degree in the region of the head 130*a* and may be downwardly sloped at a greater degree in the region of tail 128*a*.

Similarly, nozzle housing 126*b* may have a sloped top surface 138*b*. Top surface 138*b* may be raised in the region of head 130*b* relative to tail 128*b*. Top surface 138*b* may be generally downwardly sloped at a lesser degree in the region of the head 130*b* and may be downwardly sloped at a greater degree in the region of tail 128*b*.

As described above, nozzles 106*a* and 106*b* may be separately actuatable (i.e., nozzle housing are non-attached). Furthermore, nozzles 106*a* and 106*b* may be located on opposing sides of the bottle, facing outwardly from the bottle in opposing directions. As shown in FIG. 1, nozzle openings 134*a* and 134*b* are disposed on outer faces 136*a* and 136*b* of heads 134*a* and 134*b*, respectively. Therefore, in use, fluid and/or semi-fluid material can be dispensed in opposing directions. Alternatively, fluid and/or semi-fluid material can be dispensed from the first nozzle in a first direction, and the bottle can be rotated 180 degrees and fluid and/or semi-fluid material from the second nozzle can also be dispensed in the first direction.

Figure 2:
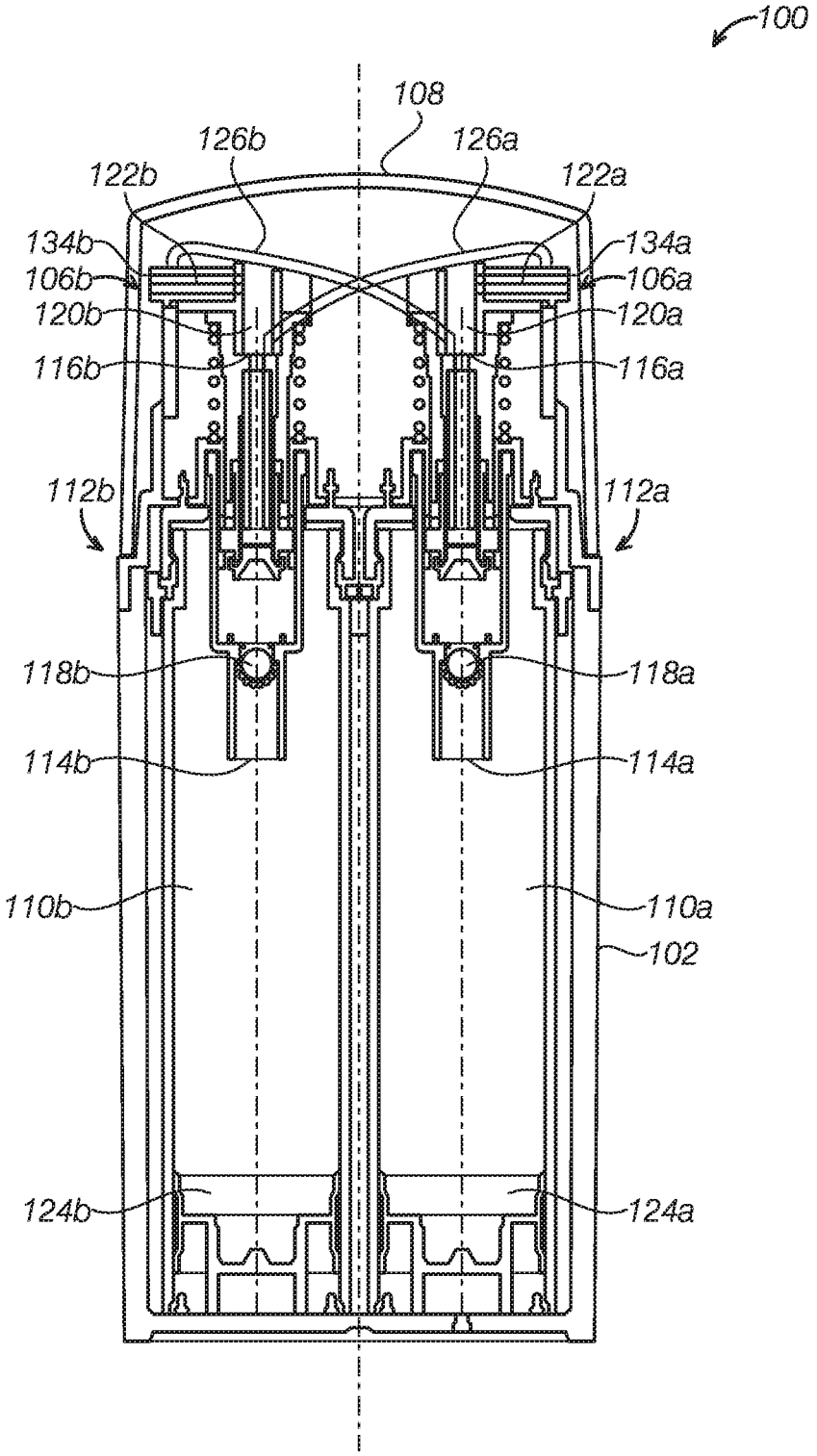
FIG. 2 is a vertical cross-sectional view of the first embodiment of the dual-chambered dispensing bottle.

Turning now to FIG. 2, each of chambers 110*a* and 110*b* may include an airless pump assemblies 112*a* and 112*b*, respectively. Airless pump assemblies 112*a* and 112*b* may include inlets 114*a* and 114*b* and outlets. Flow of fluid and/or semi-fluid material through pump assemblies 112*a* and 112*b* may be regulated through check valves 118*a* and 118*b*. Outlets 116*a* and 116*b* may be fluidly coupled to vertical tube members 120*a* and 120*b* (continuous with horizontal tube members 122*a* and 122*b*) of nozzles 106*a* and 106*b*.

Nozzle housings 126*a* and 126*b* may be configured to slide downwards from an expanded position to a compressed position in response to pressure applied by a user, thereby actuating the respective pump assembly 112*a* and 112*b*. Pump assemblies 112*a* and 112*b* may each include a respective spring. Each spring may bias the respective nozzle housing 126*a*, 126*b* into an expanded position.

Moveable pistons 124*a* and 124*b* may be slidably disposed in the bottom of internal chambers 110*a* and 110*b*, respectively, and are each configured to move toward the pump assemblies, via vacuum, as a volume of fluid and/or semi-fluid material is decreased within the internal chamber. Thus, voids in the chambers are avoided as the chambers empty of fluid. In this regard, the pump assemblies may be considered airless.

Nozzle housings 124*a* and 124*b* are disposed over nozzles 106*a* and 106*b*, respectively. The nozzle housings are each configured to be actuatable to draw fluid through the pump assemblies for dispensing of fluid and/or semi-fluid material through the nozzle.

Figure 3:
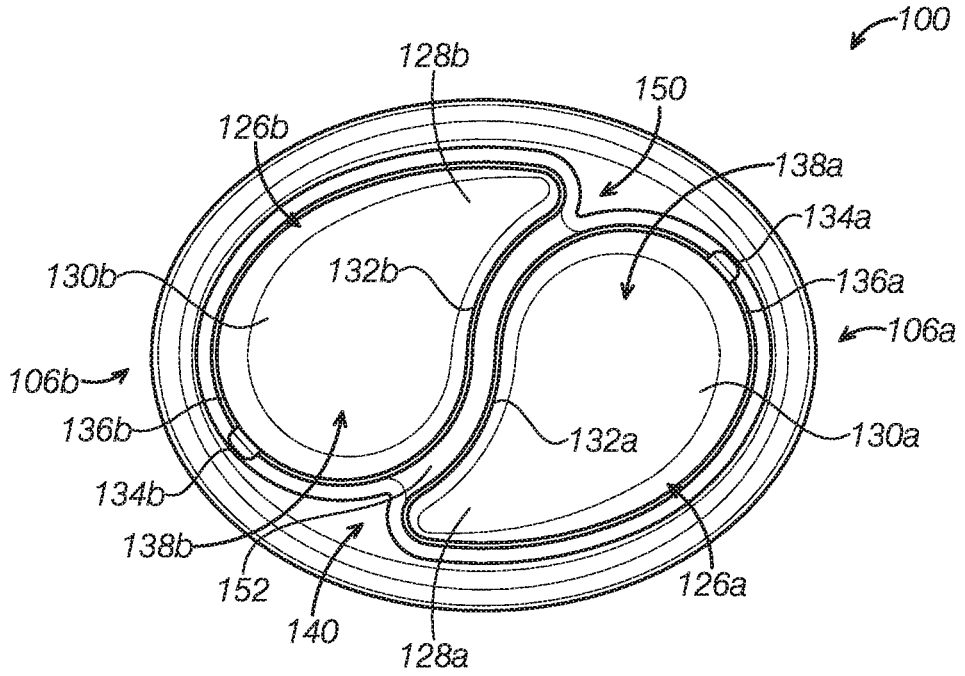
FIG. 3 is a top plan view of the first embodiment of the dual-chambered dispensing bottle.

Turning now to FIG. 3, a top plan view of bottle 100 is shown. As shown, bottle 100 may include a gap 150 between nozzle housings 126*a* and 126*b*. Gap 150 has an S-shape that is defined by inner edges of nozzle housings 126*a* and 126*b*. Gap 150 (i.e., the space between inner edges of the nozzle housings) may be supported by an S-shaped wall 152 of stepped portion 146 in sleeve 140. As described above, stepped portion 146 supports the nozzle housings and limits lateral movement of the nozzle housings. S-shaped wall 152 specifically limits lateral movement of the inner edges of the nozzle housing towards each other and allows a width of gap 150 to be maintained. Accordingly, during use, a user can easily actuate one of the nozzle housing without unintentionally actuating the other nozzle housing.

1. As depicted in FIG. 3, the nozzle housings may each have a curved tear drop shape comprised of tails (128*a* and 128*b*) and heads (130*a* and 130*b*). The nozzle housings may be aligned and complimentarily configured such that the opposing heads and tails are adjacent to each other. Specifically, head 130*a* may be aligned with and complimentarily configured to fit within a convex curvature 132*b* of tail 128*b*. Similarly, head 130*b* may be aligned with and complimentarily configured to fit within a convex curvature 132*a* of tail 128*a*. Thus, in combination, the nozzle housing may form a "yin-yang" configuration. Thus, first and second nozzle housings 126*a*, 126*b* are shaped to be free of rotational symmetry when viewed from above such that the orientation of the first and second dispensing nozzles 106*a*, 106*b* relative to each other and the exterior casing 102 is predetermined.

Figure 4:
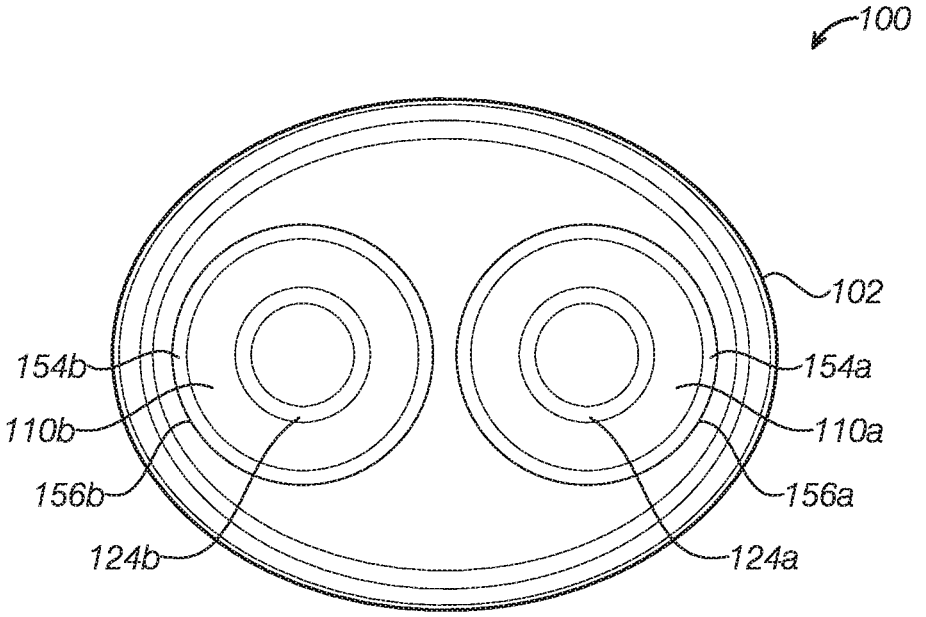
FIG. 4 is a bottom plan view of the first embodiment of the dual-chambered dispensing bottle.

FIG. 4 shows an opposing bottom plan view of bottle 100. As can be seen in FIG. 4, external casing 102 may have an oval shaped-cross section, while internal chambers 124*a* and 124*b* each may have a circular shaped-cross section. This configuration has the advantage that the circular shaped outer walls 154*a* and 154*b* of internal chambers 124*a* and 124*b* are complimentarily shaped to curved inner walls 156*a* and 156*b* (at opposing ends of the oval shape). It will be appreciated that in alternate examples, the external casing and/or the internal chambers can have a different shape (e.g., irregular, square, rectangular, triangular, hexagonal, etc.).

Figure 5:
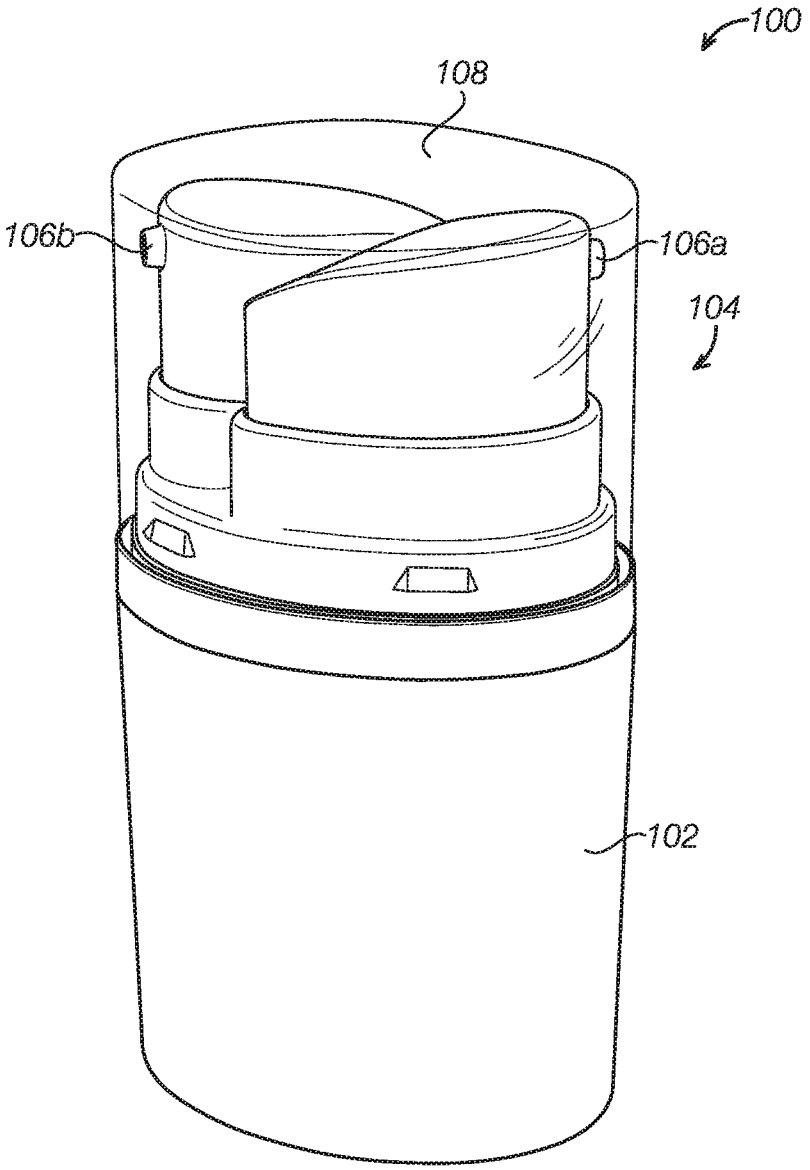
FIG. 5 is a perspective view of the first embodiment of the dual-chambered dispensing bottle, showing the lid in place on the bottle.

Turning now to FIG. 5, dual-chambered dispensing bottle 100 is shown including, lid 108 covering dual nozzle top 104. Lid 108 may cover nozzle housings 124*a* and 124*b* when attached to bottle 100 (e.g., snap-fit attachment) in order to prevent actuation of the nozzles (i.e., actuation of the nozzle housings). Lid 108 can be removed to allow a user to actuate the nozzle housings.

Figure 6:
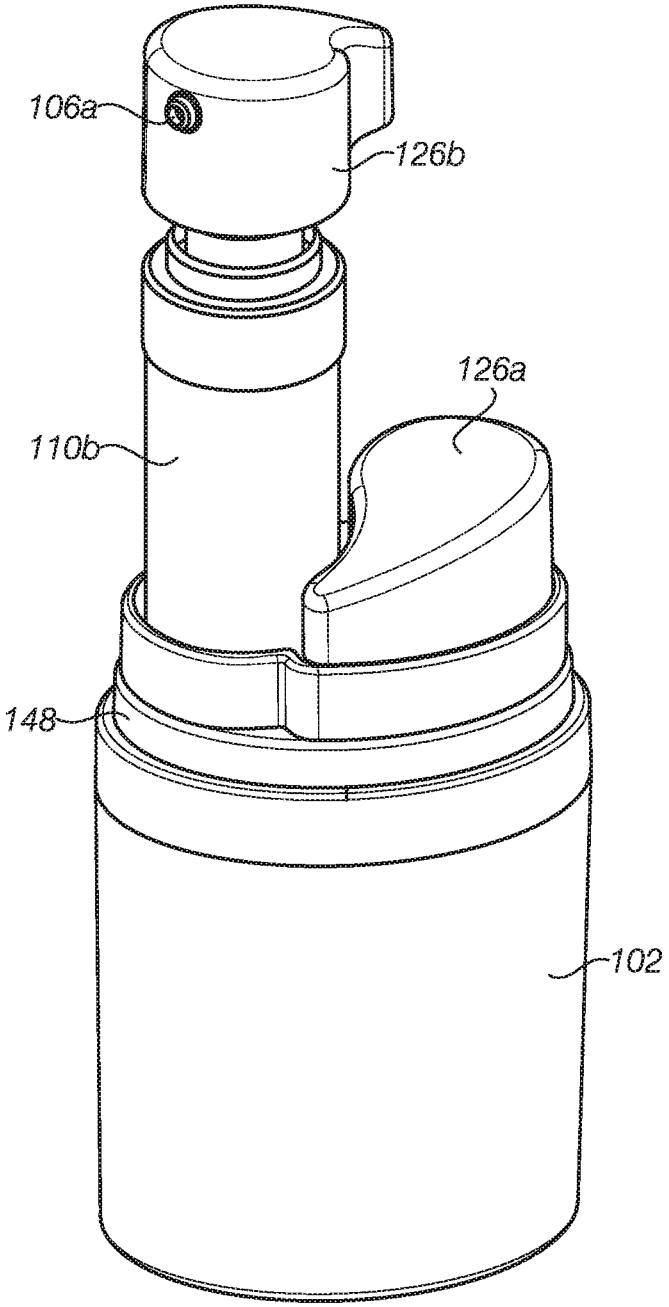
FIG. 6 is a perspective view of the first embodiment of the dual-chambered dispensing bottle, showing one of the chambers being removed for refilling.
Figure 7A:
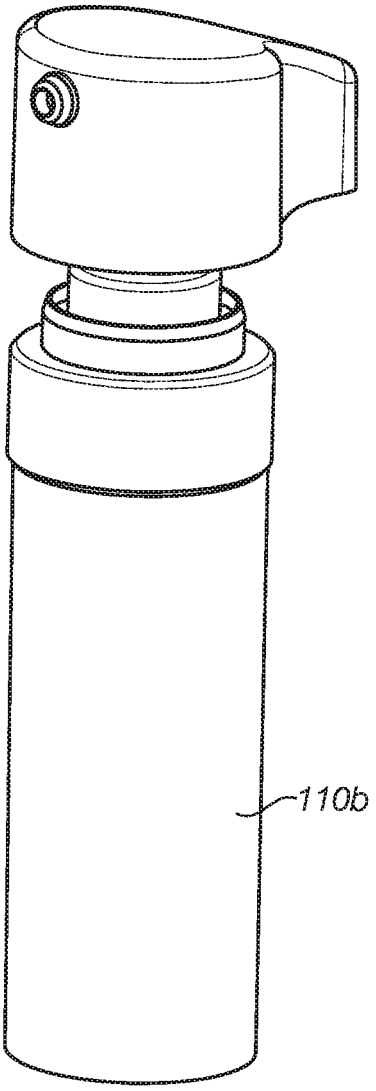
FIG. 7A is a perspective view of the chamber after being removed from the dual-chambered dispensing bottle.

As shown in FIG. 6, internal chambers 110*a*, 110*b* may be removed. In one embodiment, after being removed, as shown in FIG. 7A, the internal chamber may be replaced with a new internal chamber.

Figure 7B:
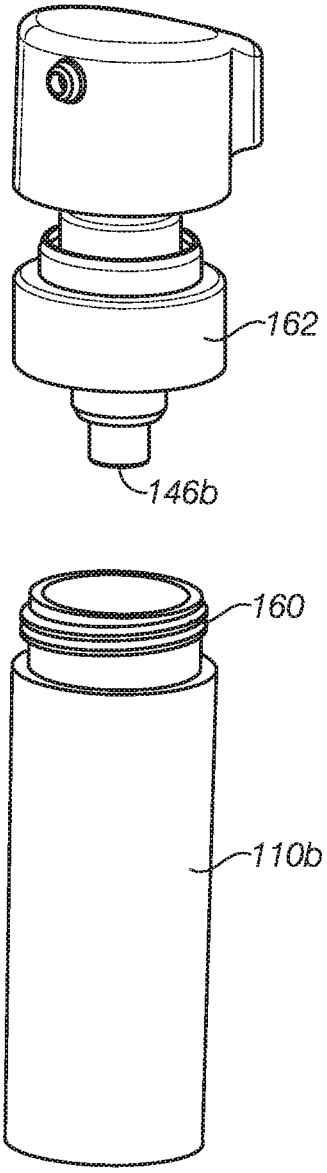
FIG. 7B is a perspective view of the chamber of FIG. 7B, showing the nozzle housing and removed from the chamber to allow refilling of the chamber.

In another embodiment, as shown in FIG. 7B, the internal chamber may be refilled and then replaced. As can be seen in FIG. 7B, nozzle collar 162 may be removably mounted to on the top end of internal chamber 110*b*, via, for example threaded connection 160.

Figure 8:
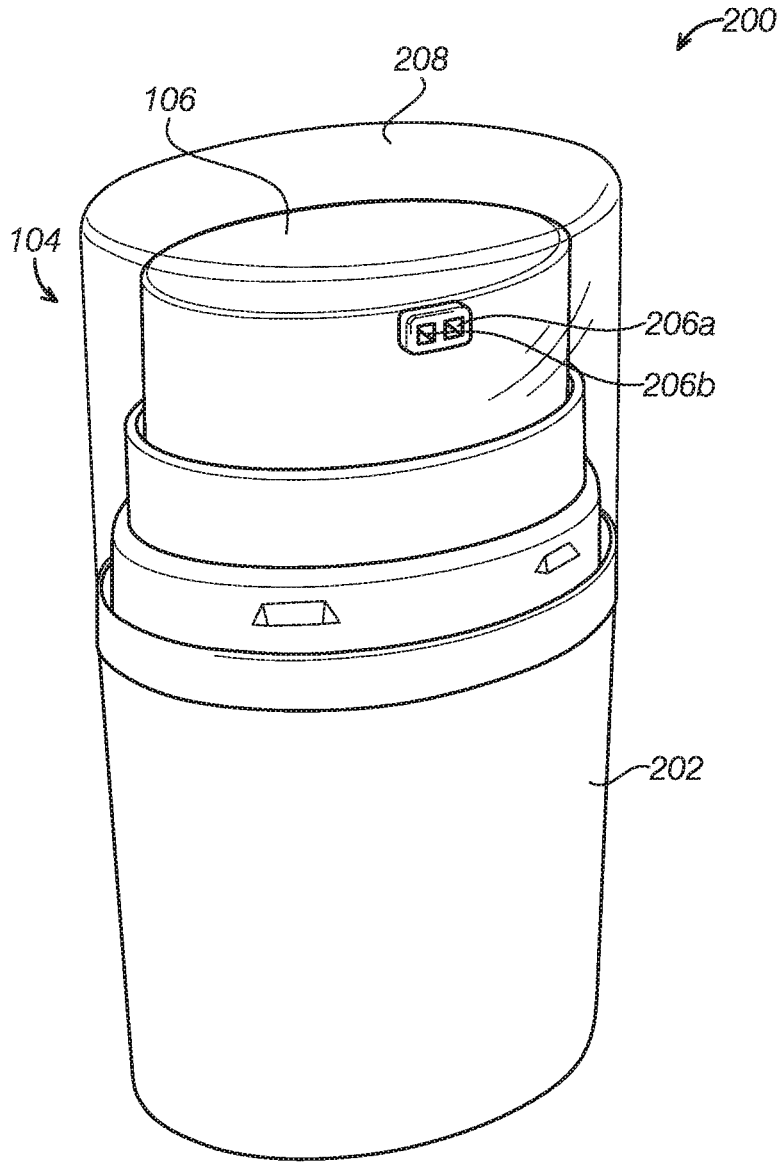
FIG. 8 is a perspective view of a second embodiment of a dual-chambered dispensing bottle, including a shared nozzle housing.

Turning attention to FIG. 8, a second example of a second example of a dual-chambered dispensing bottle, bottle 200, will now be described. Bottle 200 includes many similar or identical features to bottle 100. Thus, for the sake of brevity, each feature of bottle 200 will not be redundantly explained. Rather, key distinctions between bottle 200 and bottle 100 will be described in detail and the reader should reference the discussion above for features substantially similar between the two dual-chamber dispensing chambers.

As can be seen in FIG. 8, bottle 200 includes an exterior casing 202, a shared nozzle housing 204 having a first nozzle 206*a* and a second nozzle 206*b*, and a lid 208. Exterior casing 202 is configured to house more than one internal chamber. In the present example, the exterior casing houses two internal chambers, one of the internal chambers being in fluid communication with nozzle 206*a* and the other being in fluid communication with nozzle 206*b*. Nozzles 206*a* and 206*b* are simultaneously actuatable (i.e., attached) and are located proximal to each other on same side of the bottle and are faced outwardly from the bottle in substantially similar directions. In other examples, the bottle can include more than two internal chambers and a corresponding number of nozzles (e.g., a three chambered bottle having three nozzles, a four chambered bottle having four nozzles, etc.).

It will be further appreciated that bottle 100 can be manufactured in a variety of sizes and colorations. Bottle 100 can be color-coded and/or labeled as desired. In embodiment, the bottles may each have a transparent outer casing comprised of clear plastic, while the internal chambers may be colored and comprised of a colored plastic material. Having differing colorations to the internal chambers and/or nozzle housings can have the advantage of helping the user to easily differentiate between the two different materials stored in the chambers.

In one specific example, the internal chamber and/or nozzle housing can have a white coloration to indicate a "day-use" material, while the other internal chamber and/or nozzle housing can have a black coloration to indicate a "night-use" material. In another specific example, the internal chamber and/or nozzle can have a yellow coloration to indicate a "sun blocking" material, while the other internal chamber and/or nozzle housing can have a blue coloration to indicate a "after sun cooling" material. It will be appreciated that the internal chambers, external casing, and/or nozzle housings can have any desired coloration or combination of colorations and/or include printed material.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A fluid dispensing apparatus comprising:

a first dispensing bottle configured to dispense a first fluid or semi-fluid and comprising:

a first hollow, tubular internal chamber;

a first moveable piston slidably housed within the first internal chamber;

a first nozzle housing comprising a first inlet, a first airless pump assembly, and a first dispensing nozzle, wherein the first nozzle housing comprises a substantially curved tear drop shape comprising a head portion and a tail portion and a first nozzle collar mounted on a top end of the first internal chamber and supporting the first nozzle housing;

a second dispensing bottle configured to dispense a second fluid or semi-fluid and comprising:

a second hollow, tubular internal chamber;

a second moveable piston slidably housed within the second airless internal chamber;

a second nozzle housing comprising a second inlet, a second pump assembly, and a second dispensing nozzle, wherein the second nozzle housing comprises a substantially curved tear drop shape comprising a head portion and a tail portion and a second nozzle collar mounted on a top end of the second internal chamber and supporting the second nozzle housing; and an exterior casing housing the first and second internal chambers, the exterior casing comprising an upper opening and a sleeve disposed thereon, the sleeve having inner contours complementary to the first and second nozzle housings such that the first and second nozzle housings at least partially protrude through the sleeve; and wherein the first and second nozzles are separately actuatable so that one of the first and second nozzles can be actuated without actuating the other nozzle; and which further comprises a stepped portion in the sleeve having a S-shaped wall and a S-shaped gap defined by inner edges of the first nozzle housing and the second nozzle housing, wherein the gap is supported by the S-shaped wall.

2. The fluid dispensing apparatus of claim 1, wherein the first nozzle housing is configured to slide downwards from an expanded position to a compressed position in response to pressure applied by a user, thereby actuating the first pump assembly; and wherein the second nozzle housing is configured to slide downwards from an expanded position to a compressed position in response to pressure applied by a user, thereby actuating the second pump assembly.

3. The fluid dispensing apparatus of claim 2, wherein the first pump assembly comprises a first spring configured to bias the first nozzle housing into the expanded position; and wherein the second pump assembly comprises a second spring configured to bias the second nozzle housing into the expanded position.

4. The fluid dispensing apparatus of claim 2, wherein the first nozzle housing is located adjacent the second nozzle housing such that the user may simultaneously depress both the first and second nozzle housings.

5. The fluid dispensing apparatus of claim 1, wherein the first nozzle housing comprises a first check valve located proximal the first inlet; and wherein the second nozzle housing comprises a second check valve located proximal the second inlet.

6. The fluid dispensing apparatus of claim 1, wherein the first and second dispensing bottles are configured to be removable from the exterior casing.

7. The fluid dispensing apparatus of claim 6, wherein the first nozzle collar is removably mounted on the top end of the first internal chamber, thereby allowing the first nozzle housing to be removed and the first internal chamber to be refilled.

8. The fluid dispensing apparatus of claim 7, wherein the second nozzle collar is removably mounted on the top end of the second internal chamber, thereby allowing the second nozzle housing to be removed and the second internal chamber to be refilled.

9. The fluid dispensing apparatus of claim 1, comprising a removable lid configured to engage an outer lip of the sleeve.

10. The fluid dispensing apparatus of claim 1, wherein the first and second nozzle housings are shaped to be free of rotational symmetry when viewed from above such that the orientation of the first and second dispensing nozzles relative to each other and the exterior casing is predetermined.

11. The fluid dispensing apparatus of claim 10, wherein the first and second dispensing nozzles are located proximal each other.

12. The fluid dispensing apparatus of claim 10, wherein the first and second dispensing nozzles are on opposite sides of the fluid dispensing apparatus.

13. The fluid dispensing apparatus of claim 1, wherein the first nozzle housing and the second nozzle housing are aligned with and complimentary configured such that opposing heads and tails are adjacent each other forming a yin-yang configuration.

14. The fluid dispensing apparatus of claim 1, wherein the head of each of the first and second nozzle housings is sloped downwardly towards to tail of each of the first and second nozzle housings.

* * * * *